US006805345B2

(12) United States Patent
Furukawa

(10) Patent No.: US 6,805,345 B2
(45) Date of Patent: Oct. 19, 2004

(54) SHEET SIZE DETECTING DEVICE

(75) Inventor: Kimiaki Furukawa, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 64 days.

(21) Appl. No.: 10/383,677

(22) Filed: Mar. 10, 2003

(65) Prior Publication Data

US 2003/0184007 A1 Oct. 2, 2003

(30) Foreign Application Priority Data

Mar. 29, 2002 (JP) ..... 2002-097552

(51) Int. Cl.[7] ..... B65H 1/00
(52) U.S. Cl. ..... 271/171
(58) Field of Search ..... 271/171

(56) References Cited

U.S. PATENT DOCUMENTS 5,110,106 A * 5/1992 Matsumura et al. ..... 271/9.06
6,014,229 A * 1/2000 Yun ..... 358/449
6,619,656 B2 * 9/2003 Guddanti et al. ..... 271/171
2003/0141652 A1 * 7/2003 Guddanti et al. ..... 271/171
2003/0151188 A1 * 8/2003 Imahara ..... 271/171
2004/0051234 A1 * 3/2004 Lien et al. ..... 271/171

FOREIGN PATENT DOCUMENTS

JP 6-064781 A 3/1994
JP 7-050345 Y2 11/1995
JP 10-203653 A 8/1998

* cited by examiner

*Primary Examiner*—David H. Bollinger
(74) *Attorney, Agent, or Firm*—Foley & Lardner LLP

(57) ABSTRACT

A sheet size detecting device is provided with the following a tray in which sheets are stored, guides that can be adjusted in position in accordance with the size of sheets stored in the tray, and bit generation sections that are moved in synchronism with movement of the guides. The device detects bits based on the movement of the bit generation sections, and the number of bits detectable is larger than the number of bit generation sections by at least one. The device detects the size of sheets stored in the tray on the basis of the correspondence between the combination of detected bits and the sizes of sheets which can be stored in the tray.

4 Claims, 5 Drawing Sheets

| Sheet size | Bit pattern | | |
|---|---|---|---|
| | Port X | Port Y | Port Z |
| Size A | 0 | 0 | 1 |
| Size B | 0 | 1 | 1 |
| Size C | 0 | 1 | 0 |
| Size D | 1 | 0 | 1 |
| Size E | 1 | 1 | 1 |
| Size F | 1 | 1 | 0 |
| Size G | 1 | 0 | 0 |
| Size H | 0 | 0 | 0 |

SHEET SIZE DETECTING DEVICE

CROSS-REFERENCE TO RELATED APPLICATIONS

This application is based upon and claims the benefit of priority from the prior Japanese Patent Application No. 2002-097552, filed Mar. 29, 2002, the entire contents of which are incorporated herein by reference.

BACKGROUND OF THE INVENTION

1. Field of the Invention

The present invention relates to a sheet size detecting device for detecting the size of sheets stored in a position.

2. Description of the Related Art

Copying machines, printers or facsimile machines have a function of detecting the size of sheets stored in a predetermined position. The sheet size detection is realized by optical sensors that are selected or used in accordance with the size of sheets. The sensors are made to detect a sheet, for example when a platen cover is closed.

Jpn. Pat. Appln. KOKAI Publication No. 6-64781 discloses a technology wherein eight sheet sizes are detected by use of three sensors. According to this publication, the sheet sizes are detected by providing guides that can be adjusted in position in accordance with a size of a sheet, providing three code plates that are movable in synchronism with the guides, and arranging three sensors that detect the code plates, respectively. When sheets are stored in a tray and the guides are moved in accordance with the sheet size, a check is made to see whether or not the three sensors detect the corresponding code plates, and the sheet size is detected based on this check. To be more specific, the sheet size detection is performed as follows. For example, when the code plates are adjusted in position to increase the size from "size 1" to "size 8" in turn, a check is made to see whether the sensors detect the sheets. The detected states of the sensors are determined by comparing the detection signals with eight bit combination patterns, which are determined beforehand and correspond to different bit information of different sheet sizes.

Since the sheet size detecting device employs sensors in accordance with the number of sheet types, a large number of sensors are required. For example, if the sheet size detecting device detects eight types of sheets, eight sensors are required. Due to the necessity of using a large number of sensors, the sheet size detecting device is inevitably large in size and costly.

In the sheet size detecting method of Jpn. Pat. Appln. KOKAI Publication No. 6-64781, three code plates and three sensors are required for detecting eight sheet sizes. That is, the bit generation means and the bit detection means must be equal in number.

BRIEF SUMMARY OF THE INVENTION

Accordingly, an object of the present invention is to provide a sheet size detecting device which can detect sheet sizes by means of a compact structure, and which can be provided at low cost.

A sheet size detecting device according to one aspect of the present invention comprises: a tray in which sheets are stored; guides that can be adjusted in position in accordance with the size of sheets stored in the tray; and bit generation sections that are moved in synchronism with movement of the guides. The device detects bits based on the movement of the bit generation sections, and the number of bits detectable is larger than the number of bit generation sections by at least one. The device detects the size of sheets stored in the tray based on the correspondence between the combination of detected bits and the sizes of sheets that can be stored in the tray.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

One embodiment of the present invention will now be described with reference to the accompanying drawings. In the embodiment, a sheet size detecting device 2 is provided for the manual insertion tray 11 of a copying machine 1 shown in FIG. 5.

(First Embodiment)

Figure 1:
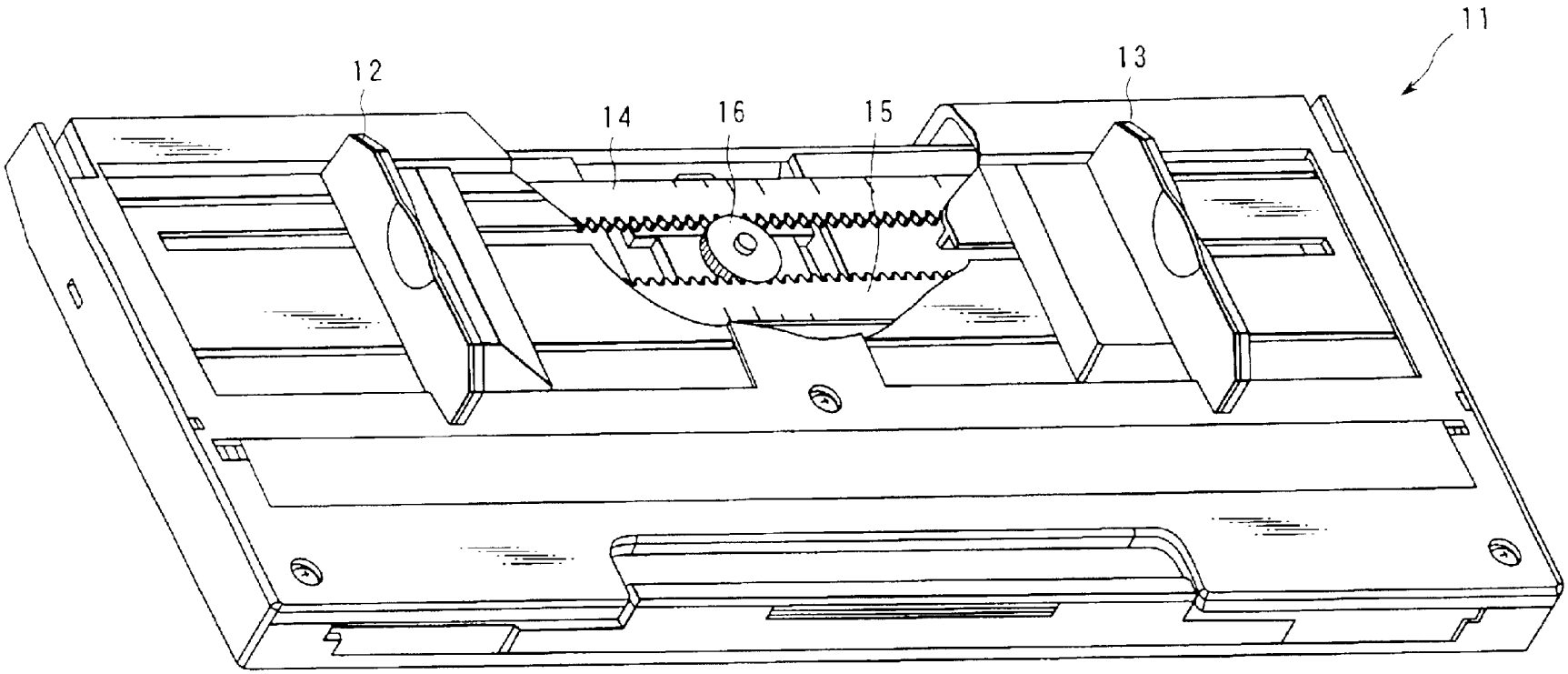
FIG. 1 shows the outward appearance of a tray according to one embodiment of the present invention, as well as part of the internal structure of the tray.

FIG. 1 shows the outward appearance of the manual insertion tray 11 as well as part of the internal structure of the tray 11. The tray 11 has two guides 12 and 13 each having a substantially "L"-shaped cross section. The guides 12 and 13 are movable in the longitudinal direction of the tray 11 in accordance with the size of sheets to be used. Each of the L-shaped guides is made up of two plates, one plate being parallel to the manual insertion tray 11, and the other plate being perpendicular thereto. Sheets are stored between the plates that are perpendicular to the manual insertion tray 11.

Guide 12 is integrally assembled with a rack gear 14. The rack gear 14 is in mesh with a pinion gear 16 which is rotatable around an axis perpendicular to the moving direction of the guide 12. Likewise, guide 13 is integrally assembled with a rack gear 15. This rack gear 15 is also in mesh with the pinion gear 16 and extends in parallel to the rack gear 14 described above. With this structure, when one of the guides 12 and 13 is moved in accordance with a sheet size, the other guide move in the opposite direction simultaneously. Therefore, the center of the sheets is always at the same position without reference to the sizes of the sheets, i.e., without reference to the adjustment of guides 12 and 13.

Sheets of eight sizes "A" to "H" can be stored in the manual insertion tray 11. The sheet size increases from size "A" to size "H" in this order.

Figure 2:
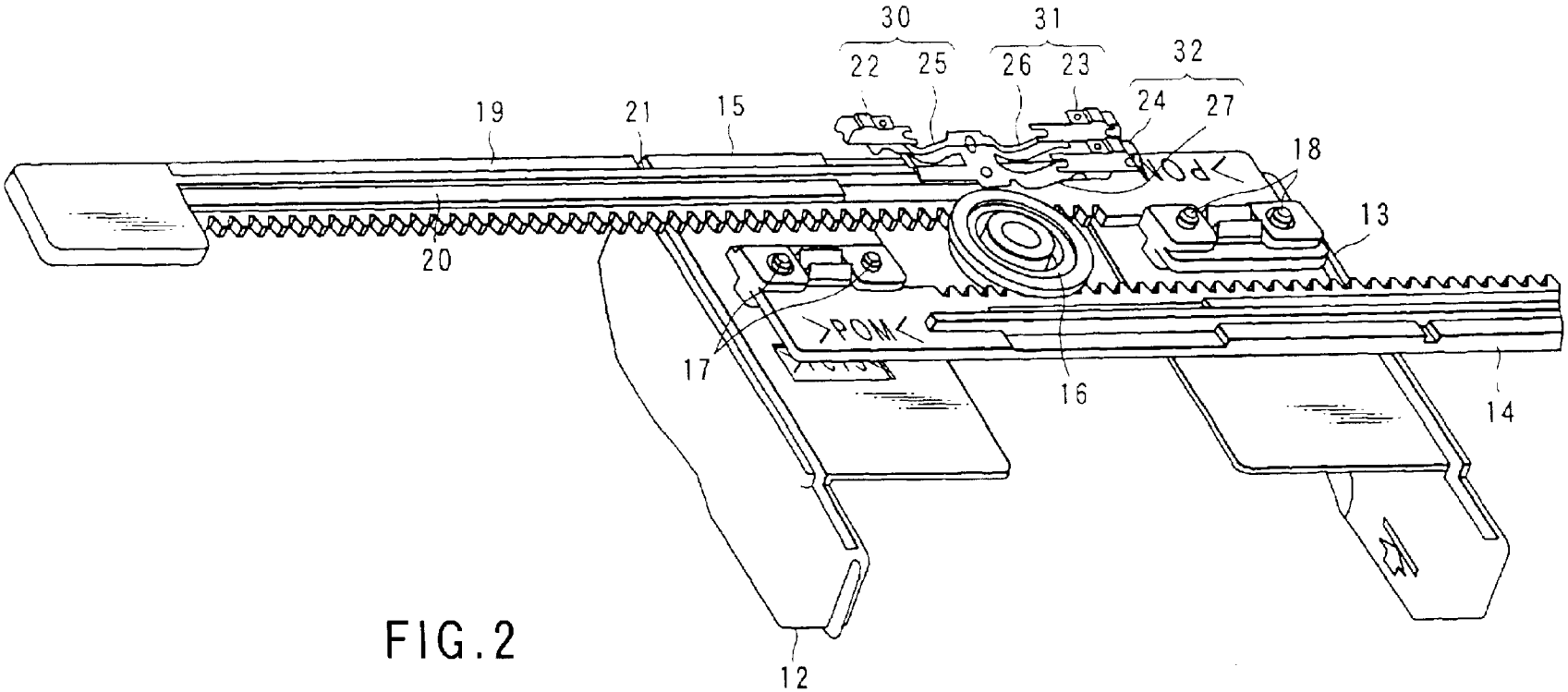
FIG. 2 shows a sheet size detecting mechanism.

FIG. 2 shows a mechanism for detecting a sheet size when sheets are stored in the manual insertion tray 11 and the guides are adjusted in accordance with the size of the sheets. It should be noted that FIG. 2 shows the sides of the pinion gear 16, rack gear 14 and rack gear 15 that are opposite to the sides shown in FIG. 1. In other words, the pinion gear 16, rack gear 14 and rack gear 15 shown in FIG. 1 are depicted upside down in FIG. 2. The plate of guide 12 that is parallel to the manual insertion tray 11 is fixed to one end of rack gear 14 by means of bolts 17, and the plate of guide 13 that is parallel to the manual insertion tray 11 is fixed to one end of rack gear 15 by means of bolts 18. With this structure, guides 12 and 13 are integrally assembled with rack gears 14 and 15, respectively. The rack gears 14 and 15 are opposed to each other and in mesh with the pinion gear 16 located therebetween.

The rack gear 15 has bit generating sections 19 and 20 to determine the guide positions. The bit generating section 19 has a rectangular projected portion extending in the moving direction of the guide 13. A depressed portion (a hollow section) 21 is located at the predetermined position of the projected portion. Likewise, the bit generating section 20 has a rectangular projected portion extending in the moving direction of the guide 13.

Electric switches made up of stationary metal terminals and conductive elastic members and serving as bit detecting sections are located at positions to which the bit generating sections 19 and 20 of the rack gear 15 are movable. As shown in FIG. 2, the stationary metal terminals 22, 23 and 24 are prevented from moving together with the rack gear 15. To be more specific, they are fixed inside the manual insertion tray 11. They are supported by means of support members, for example. Two (22, 23) of the stationary metal terminals are provided at positions to which bit generating section 19 is movable, and the remaining one (24) is provided at a position to which bit generating section 20 is movable.

Figures 5, 6:
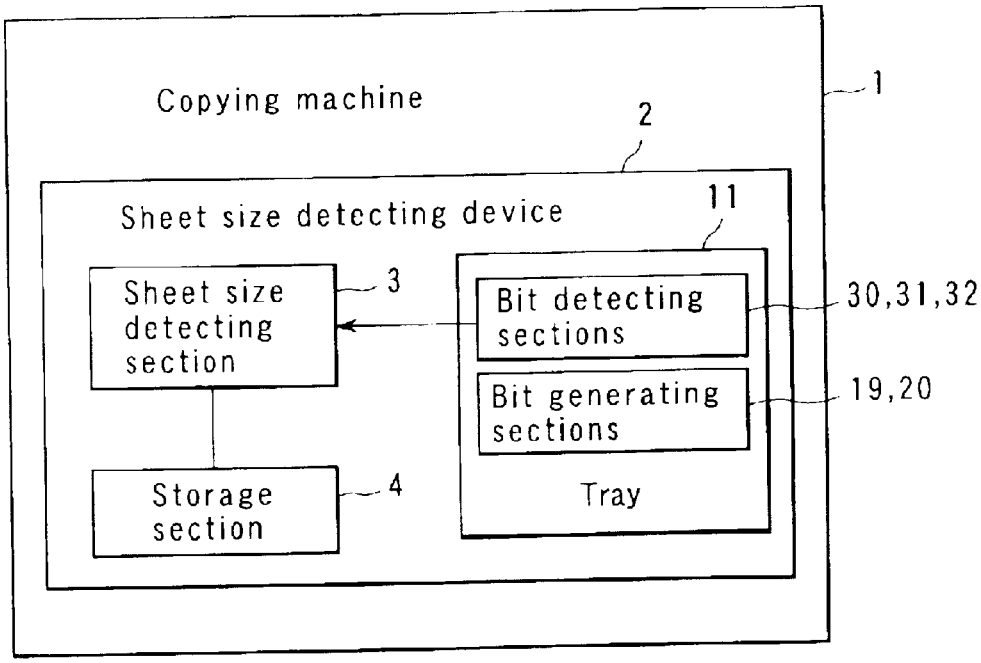
FIG. 5 is a schematic diagram showing a control block of a sheet size detecting device.
FIG. 6 is a table illustrating the correspondence between detected bit patterns and sheet sizes.

The elastic conductive members 25, 26 and 27 are located between the stationary metal terminals 22, 23 and 24 and the moving tracks of the bit generating sections 19 and 20. One-end portions of the conductive elastic members 25, 26 and 27 are secured inside the manual insertion tray 11. When the bit generating sections 19 and 20 move and the projected portions come to predetermined positions, one end of conductive elastic member 25 comes into contact with stationary metal terminal 22. A bit is detectable in this electrically conductive state. Therefore, the conductive elastic member and the stationary metal terminal jointly function as an electric switch. Bit detection signals from the three electric switches are supplied to ports X, Y and Z, respectively, and these ports are formed in the sheet size detecting section 3 that is provided for the sheet size detecting device 2, as shown in FIG. 5.

Figure 3:
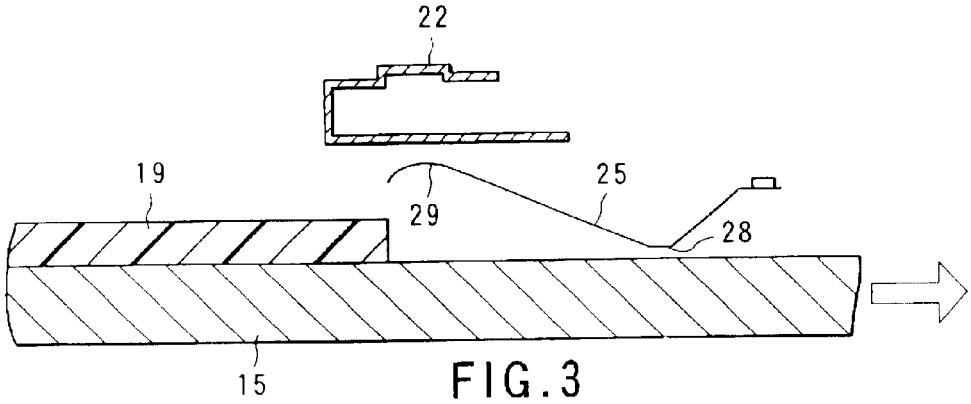
FIG. 3 is a schematic diagram showing a cross section of a bit detecting mechanism.

FIG. 3 is a schematic diagram showing a cross section of a mechanism that is configured to detect a bit when the electric switch is turned on.

The bit generating section 19, which is integral with the rack gear 15, moves in the direction indicated by the arrow in FIG. 3, in synchronism with the movement of the guide 13. The stationary metal terminal 22 and the conductive elastic member 25 are located at positions toward which the bit generating section 19 moves.

The conductive elastic member 25 has a cross section substantially in the shape of "S." When the bit generating section 19 moves, its projected portion raises the concave portion 28 of the conductive elastic member 25 (i.e., the concave portion 28 is moved in the upward direction as viewed in FIG. 3). When the concave portion 28 of the conductive elastic member 25 is raised, the convex portion 29 of the conductive elastic member 25 is raised as well and brought into contact with the stationary metal terminal 22. When the conductive elastic member 25 and the stationary metal terminal 22 are in contact with each other, a current is allowed to flow, and the electric switch 30 detects a bit.

When the rack gear 15 moves further, the depressed portion of the hit generating section 19 comes to the position of the concave portion 28 of the conductive elastic member 25. At this time, the conductive elastic member 25 returns to its original position because of the elasticity thereof. Since the conductive elastic member 25 is separated from the stationary metal terminal 22, the electric switch 30 no longer detects a bit.

As can be seen from the above, the movement of the bit generating section 19 provided with the depressed portion 21 at the predetermined positions allows detection of four bit combination patterns, namely, the patterns determined by whether or not electric switch 30 (made up of stationary metal terminal 22 and conductive elastic member 25) detects a bit and by whether or not electric switch 31 (made up of stationary metal terminal 23 and conductive elastic member 26) detects a bit. In addition, the movement of the bit generating section 20 allows detection of two bit combination patterns, namely, the patterns determined by whether or not electric switch 32 (made up of stationary metal terminal 24 and conductive elastic member 27) detects a bit. Hence, the manual insertion tray 11 can detect eight sheet sizes.

Figure 4:
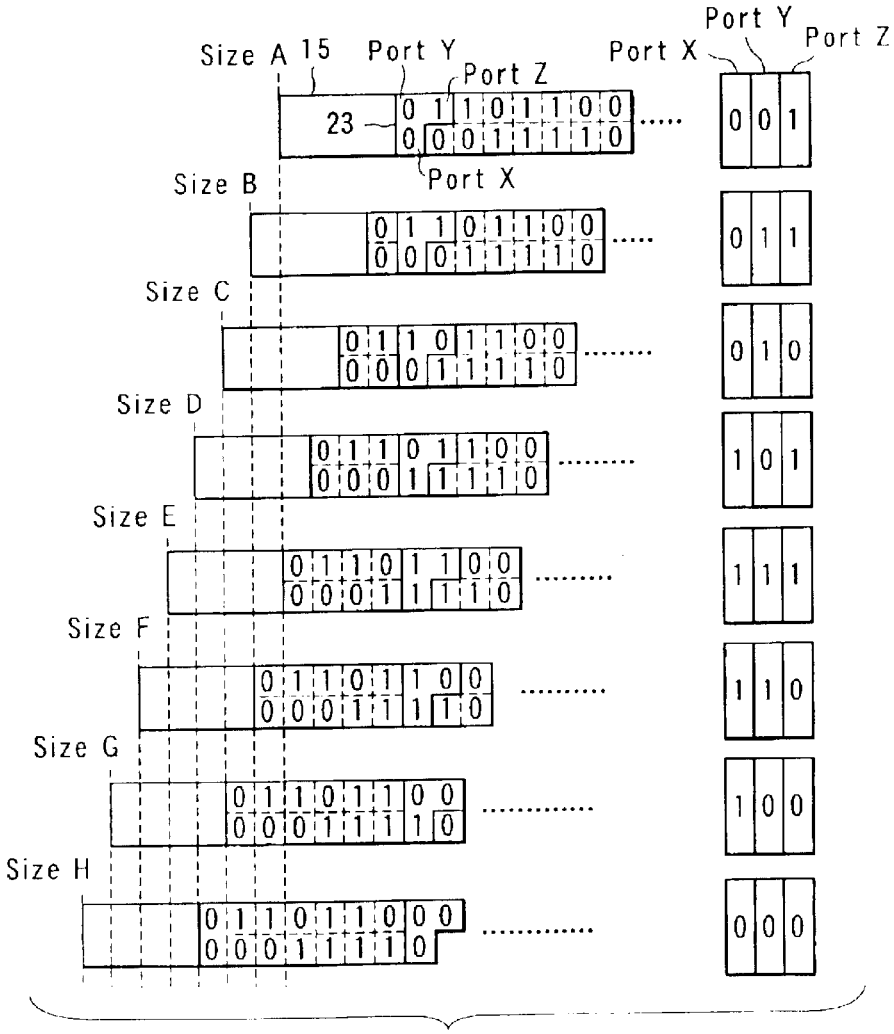
FIG. 4 illustrates how sheet sizes are detected.

FIG. 4 illustrates how the sheet sizes are detected based on bits detected by the electric switches 30, 31 and 32.

In FIG. 4, the numbers within the thick-line frames indicate bit information which the electric switches 30, 31 and 32 output when the guides 12 and 13 are moved in accordance with the sheets of sizes A to H and the rack gear 15 moves accordingly. The bit detected by electric switch 30 is output to port X, the bit detected by electric switch 31 is output to port Y, and the bit detected by electric switch 32 is output to port Z.

When the guides 12 and 13 are adjusted to the positions of size A (in which case, sheets have the narrowest width), "0", "0" and "1" are output to ports X, Y and Z. The bit information detected by the electric switches 30, 31 and 32 changes each time sheets of a different size are used. The bits output to ports X, Y and Z are "0,1,1" in the case of size B, "0,1,0" in the case of size C, "1,0,1" in the case of size D, "1,1,1" in the case of size E, "1,1,0" in the case of size F, "1,0,0" in the case of size G, and "0,0,0" in the case of size H.

As described above, when the guides 12 and 13 adjusted in accordance with the sizes of sheets, the electric switches 30, 31 and 32 output eight kinds of bit information dependent on the sheet sizes. As shown in FIG. 6, a storage section 4 electrically connected to the sheet size detecting section 3 's made to store eight bit combination patterns corresponding to sheet sizes beforehand. Each time the sheet size detecting section 3 detects a sheet, the combinations of the bits output from the electric switches 30, 31 and 32 is compared with the bit combinations patterns stored in the storage section 4, thereby detecting the size of the sheet.

In the present embodiment, the bit generating section 19 provided with the projected portion and the depressed portion 21 located at the predetermined position, and the bit generating section 20 provided with the projected portion, are arranged in parallel to the rack gear 14 and are movable in the direction in which the guides are movable. The electric switches 30 and 31 are located at positions to which the bit generating section 19 is movable. Likewise, the electric switch 32 is located at a position to which the bit generating section 20 is movable. With this configuration, 3-bit information is obtained regarding the size of the sheets stored in the manual insertion tray 11, and the 3-bit information can be compared with the bit combination patterns corresponding to the eight sheet sizes. Therefore, the controller of the copying machine 1 can detect eight sheet sizes.

Unlike the prior art configuration, the present embodiment does not have to employ three bit generating sections. That is to say, the present embodiment uses two bit generating sections 19 and 20, and detection of eight sheet sizes is enabled. Hence, the manual insertion tray 11 has a decreased width, and the sheet size detecting device is compact in size and does not occupy much space.

The bit generating sections 19 and 20 are arranged in two rows. With this configuration, a product error, such as a phase shift between adjacent rows, is prevented, and yet the structure is simple. It is therefore possible to provide a sheet size detecting device which is fabricated with high precision and at low cost.

In the first embodiment described above, the two bit generating sections 19 and 20 have projected and depressed portions, and these portions are detected by the electric switches 30, 31 and 32. However, the present invention is not limited to this. For example, a bit generating section may be provided with a notch detectable by an electric switch.

Furthermore, it is not necessary to employ an electric switch for bit detection. A sensor (e.g., a light sensor) may be arranged at a predetermined position, and the projected portion and the depressed portion or notch may be detected by checking whether light has passed or blocked.

(Second Embodiment)

The second embodiment of the present invention will now be described. Structural elements that are similar or correspond to those of the first embodiment are denoted by the same reference numerals, and a detailed description of such structural elements will be omitted.

Figure 7:
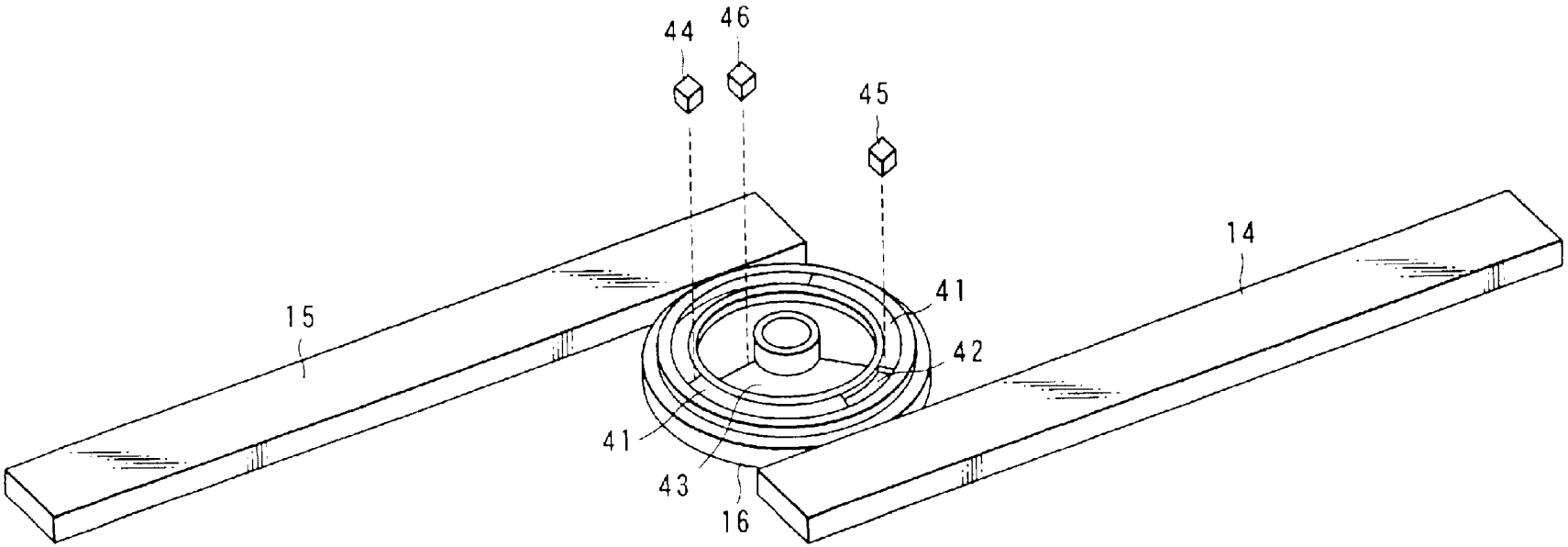
FIG. 7 is a schematic diagram showing how a sheet size is detected according to the second embodiment of the present invention.

FIG. 7 is a schematic diagram showing how a sheet size is detected according to the second embodiment of the present invention.

In the manual insertion tray 11 of the first embodiment, the rack gear 15 is provided with the bit generating sections 19 and 20. The manual insertion tray of the second embodiment does not employ this structure. In place of this structure, a pinion gear 16 rotatable on an axis of rotation is provided with circular bit generating sections 41 and 43. Bit generating section 41 includes a projected portion extending in the rotating direction of the pinion gear 16, and a depressed portion 42 formed at the predetermined position of the projected portion. Bit generating section 43 is provided radially inward of bit generating section 41 and has a depressed portion extending in the rotating direction of the pinion gear 16.

The projected portions of the bit generating sections 41 and 43 are covered with coatings that reflect light. Reflection type sensors 44 and 45 are provided for bit generating section 41, and reflection type sensor 46 is provided for bit generating section 43. When the reflection type sensors 44, 45 and 46 detect the projected portions of the bit generating sections 41 and 43, they detect bits being generated.

With this configuration, the bit generating sections 41 and 43 rotate together with the pinion gear 16. The rotation of the bit generating section 41 allows detection of four bit combination patterns, namely, the patterns determined by whether or not reflection type sensor 44 detects a bit and by whether or not reflection type sensor 45 detects a bit. In addition, the rotation of the hit generating section 43 allows detection of two bit combination patterns, namely, the patterns determined by whether or not reflection type sensor 46 detects a bit. Hence, the manual insertion tray 11 of the second embodiment can detect eight sheet sizes, like the tray 11 of the first embodiment.

Rack gears 14 and 15 engaging with the pinion gear 16 extend in parallel to each other. Therefore, the diameter of the pinion gear 16 is determined in such a manner that the circumference of the pinion gear 16 is equal to one half of the width required for detecting all sheet sizes. That is, the diameter of the pinion gear 16 is defined by (maximum of detectable sheet width)/2 $\pi$.

According to the second embodiment, 3-bit information is obtained regarding the size of the sheets stored in the manual insertion tray 11, and that 3-bit information can be compared with predetermined bit combination patterns corresponding to the eight sheet sizes. Therefore, the controller of the copying machine can detect eight sheet sizes.

As described above, three bit generating sections are not required, as in the prior art. Since the second embodiment can detect eight sheet sizes by use of only two bit generating sections 41 and 43, and the diameter of the pinion gear is defined is (maximum of detectable sheet width)/2$\pi$, it is possible to provide a sheet size detecting device whose manual insertion tray is compact in size and does not occupy much space.

The bit generating sections 19 and 20 are arranged in two concentric patterns. With this configuration, a product error, such as a phase shift between adjacent patterns, is prevented, and yet the structure is simple. It is therefore possible to provide a sheet size detecting device which is fabricated with high precision and at low cost.

In the second embodiment as well, the two bit generating sections 41 and 43 may be provided with a notch detectable by a light sensor. Needless to say, the bit detecting section may be an electric switch, as in the first embodiment.

The embodiments were described, referring to the case where the present invention is applied to the manual insertion tray 11 of a copying machine 1. The present invention is in no way limited to this. For example, it is applicable to a sheet size detecting device provided at a predetermined position of a sheet feed cassette to detect the size of sheets stored therein.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet size detecting device comprising:

a tray in which sheets are stored;

guides that can be adjusted in position in accordance with a size of the sheets stored in the tray;

bit generation sections that are moved in synchronism with movement of the guides;

a bit detecting section that detects bits greater in number than the bit generating sections by at least one, based on movement of the bit generating sections;

a storage section that stores data on correspondence between combinations of bits detected by the bit detecting section and sizes of sheets which can be stored in the tray; and a sheet size detecting section that detects a size of sheets stored in the tray, based on the bits detected by the bit detecting section and the data stored in the storage section.

2. A sheet size detecting device according to claim 1, wherein the bit generating sections include projected and depressed portions that are moved in a longitudinal direction thereof, and the bit detecting section detects a bit generated when the projected portion of the bit generating sections is moved to a predetermined position, turning on an electric switch.

3. A sheet size detecting device comprising:

a tray in which sheets are stored;

guides that can be adjusted in position in accordance with a size of the sheets stored in the tray;

bit generation sections that are rotated on an axis perpendicular to a moving direction of the guides, in synchronism with movement of the guides;

a bit detecting section that detects bits based on rotation of the bit generating sections;

a storage section that stores data on correspondence between combinations of bits detected by the bit detecting section and sizes of sheets which can be stored in the tray; and a sheet size detecting section that detects a size of sheets stored in the tray, based on the bits detected by the bit detecting section and the data stored in the storage section.

4. A sheet size detecting device according to claim 3, wherein the bit detecting section detects bits which are greater in number than the bit generating sections by at least one.

* * * * *